US007270599B2

(12) United States Patent
Hu et al.

(10) Patent No.: US 7,270,599 B2
(45) Date of Patent: Sep. 18, 2007

(54) COIN OUTLET UNIT

(75) Inventors: Chia-Hung Hu, Taipei (TW); Ting-Kuo Lin, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 0 days.

(21) Appl. No.: 11/162,721

(22) Filed: Sep. 20, 2005

(65) Prior Publication Data

US 2007/0066202 A1 Mar. 22, 2007

(51) Int. Cl.
*G07F 1/00* (2006.01)
*G07D 1/00* (2006.01)

(52) U.S. Cl. ..... 453/18; 453/50; 453/51; 453/52; 194/344; 194/351; 221/241

(58) Field of Classification Search ..... 453/18, 453/30, 33–35, 49–54, 57; 221/241; 194/350, 194/344, 351
See application file for complete search history.

(56) References Cited

U.S. PATENT DOCUMENTS 6,059,651 A * 5/2000 Abe et al. ..... 453/30
6,709,324 B1 * 3/2004 Beadell ..... 453/29

* cited by examiner

*Primary Examiner*—Patrick Mackey
*Assistant Examiner*—Mark J. Beauchaine

(57) ABSTRACT

A coin outlet unit is disclosed to include a casing having a coin outlet, and an adjustment structure for adjusting the size of the coin outlet. The adjustment structure positioning spaces arranged in a line perpendicular to the extending direction of the coin outlet, locating holes arranged in parallel to the positioning spaces, an adjustment block, which has a bottom rod selectably inserted into one of the positioning spaces and a plurality of adjustment holes, and a locking member insertable through the adjustment holes into the locating holes to lock the adjustment block.

11 Claims, 7 Drawing Sheets

COIN OUTLET UNIT

BACKGROUND OF THE INVENTION

1. Field of the Invention

The present invention relates to a coin outlet unit for use in a coin counting machine and more particularly, to such a coin outlet, which has adjustment means for adjusting the size of the coin outlet conveniently without changing any structure.

2. Description of the Related Art

A coin outlet unit is to be used in a coin counting machine for collecting and dispensing coins for counting. A coin outlet unit for this purpose has a coin outlet made to fit coins of a particular value. Therefore, for counting different coins, different coin outlet units should be used. It is not economic to prepare different coin outlet units for different coins.

FIG. 7 shows a conventional coin outlet unit for this purpose. This design of coin outlet unit comprises a casing, a coin hopper, a rotary table, a servomotor, a push wheel, a coin ejector, and steel balls. The push wheel is changeable subject to the coins to be dispensed. However, this design of coin outlet unit still has drawbacks as outlined hereinafter.

1. The push wheel B1 has multiple curved sides B2 made to fit coins B3 of a particular value. When dispensing coins B3 of a different value, the push wheel B1 must be changed. Therefore, the manufacturer must prepare many different push wheels B1 to fit different coins B3.

2. The push wheel B1 has one side supported on a spring strip B5, and the coin ejector B4 is constrained by a spring member B6. When one coin B3 is stopped between one curved side B2 of the push wheel B1 and a roller B7 of the coin ejector B4, the rotary table B8 receives a great resisting force from the spring strip B5 and the spring member B6. At this time, a great biasing force must be applied to the rotary table B8 to overcome the spring power of the spring strip B5 and the spring member B6. Because the rotary table B8 frequently bears a great resisting force, it wears quickly with use.

SUMMARY OF THE INVENTION

The present invention has been accomplished under the circumstances in view. It is therefore the main object the present invention to provide a coin outlet unit, which fits any of a variety of coins. It is another object of the present invention to provide a coin outlet unit, which is durable in use.

According to one aspect of the present invention, the coin outlet unit comprises a casing having a coin outlet, a transmission mechanism mounted inside the casing, a coin hopper provided above the casing and adapted to collect coins, a rotary table suspending inside the casing below the coin hopper and rotatable by the transmission mechanism to carry coins out of the coin hopper to the coin outlet, and an adjustment structure adapted to adjust the size of the coin outlet. According to another aspect of the present invention, the adjustment structure comprises an elongated positioning trough formed in the casing at one side of the coin outlet, a plurality of protruding stop portions disposed in the elongated positioning trough and dividing the positioning trough into a plurality of positioning spaces arranged in a line perpendicular to the extending direction of the coin outlet, a limiter spaced from the positioning trough at one side, the limiter comprising a plurality of locating holes arranged in parallel to the positioning spaces, an adjustment block selectively positionable in one of the positioning spaces and lockable to the locating holes to adjust the size of the coin outlet, the adjustment block comprising a plurality of adjustment holes, and a positioning structure adapted to selectively lock the adjustment block to one of the positioning spaces to control the size of the coin outlet. According to still another aspect of the present invention, the positioning spaces are partially merged into one another to shorten the distance between each two adjacent positioning spaces so that the adjustment block can be moved to adjust the size of the coin outlet without a long displacement.

DETAILED DESCRIPTION OF THE PREFERRED EMBODIMENT

Figure 1:
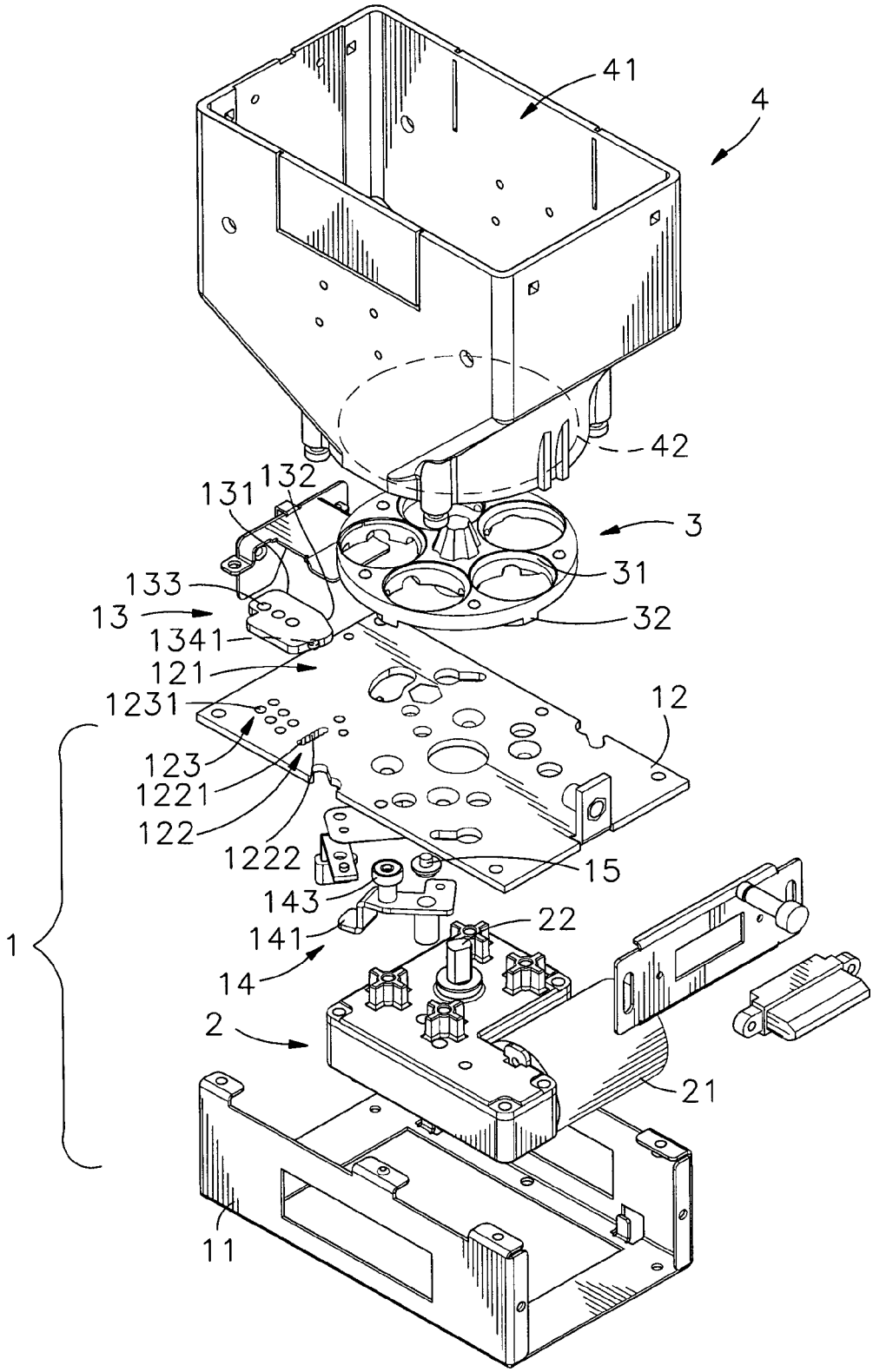
FIG. 1 is a perspective exploded view of a coin outlet unit according to the present invention.
Figure 2:
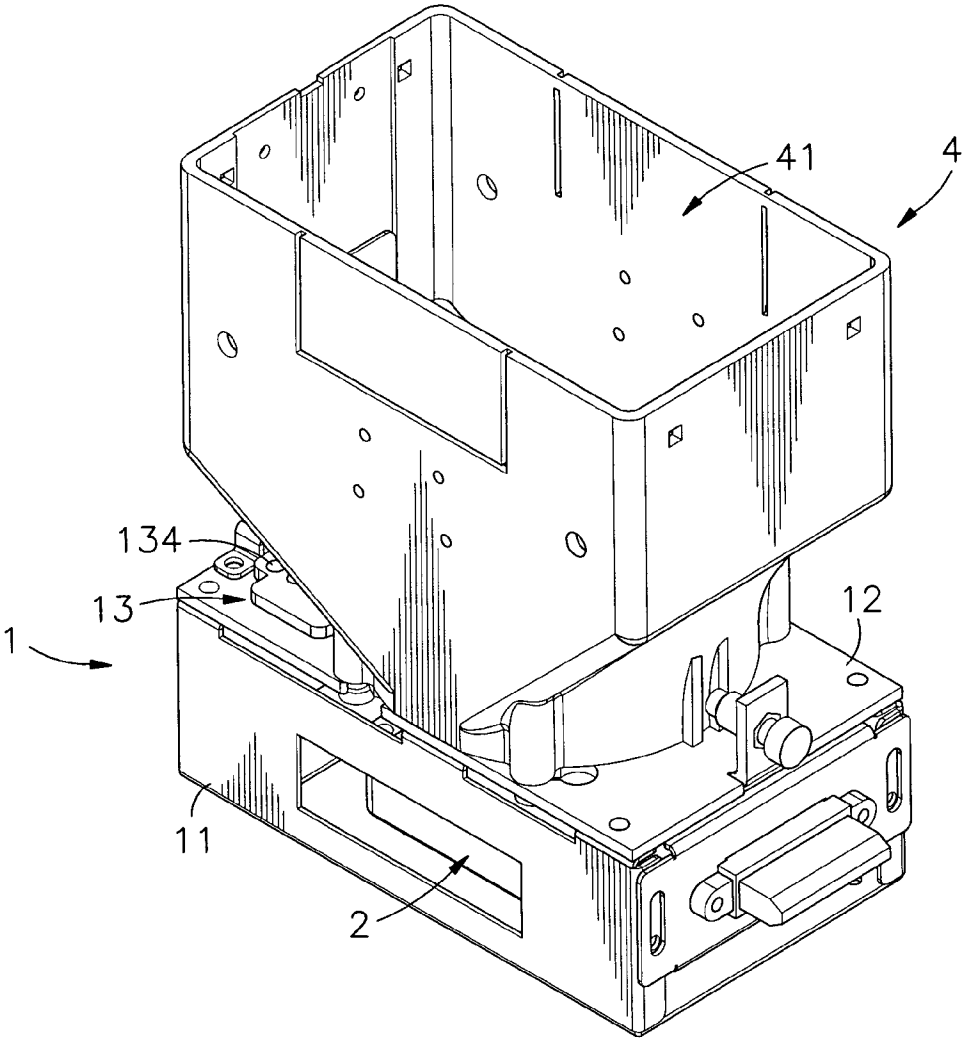
FIG. 2 is an elevational assembly view of the coin outlet unit according to the present invention.
Figure 3:
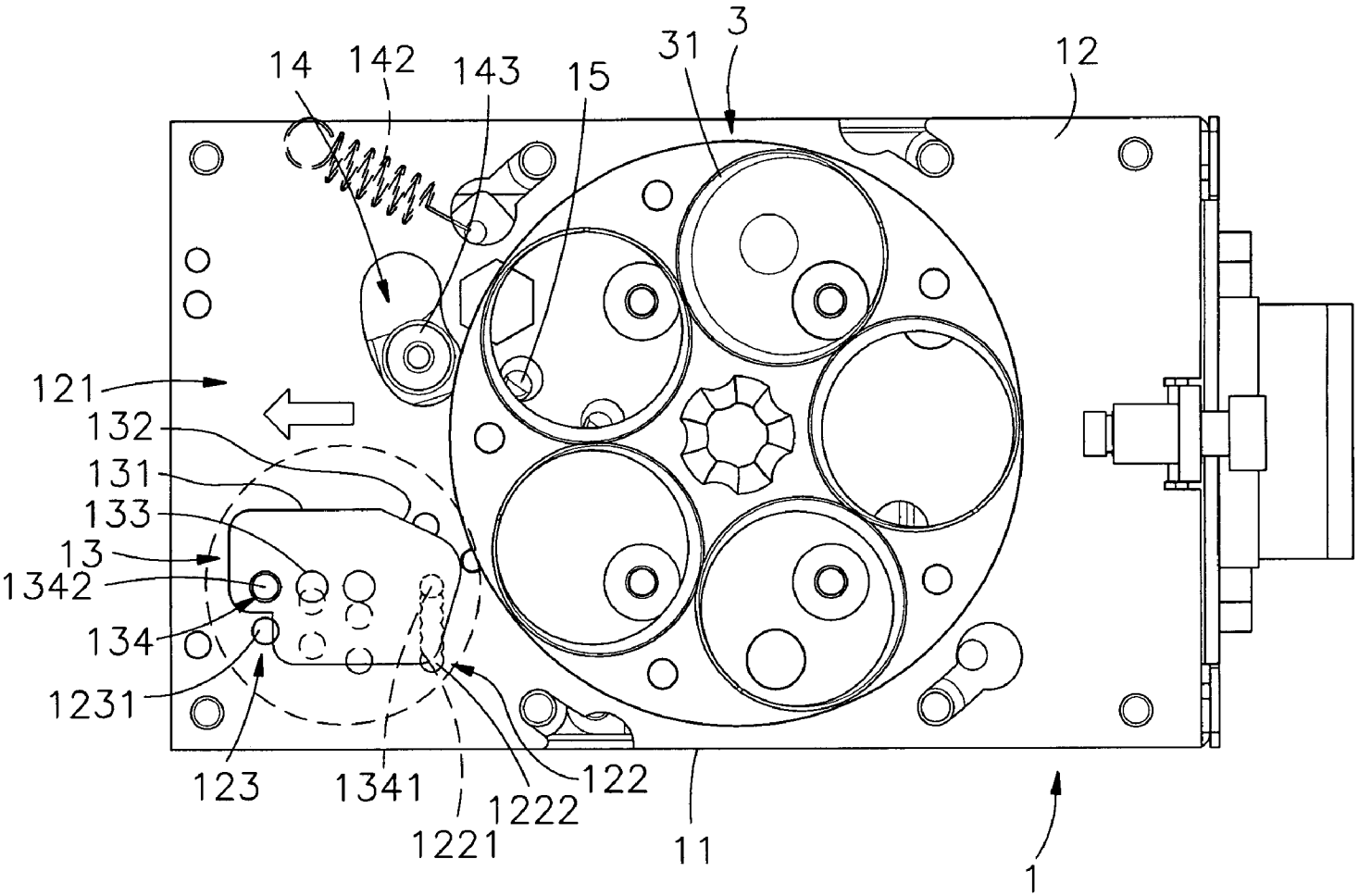
FIG. 3 is a schematic top view of the coin outlet unit according to the present invention.

Referring to FIGS. 1~3, a coin outlet unit in accordance with the present invention is shown comprised of a casing 1, a transmission mechanism 2, a rotary table 3, and a coin hopper 4.

The casing 1 comprises a hollow bottom shell 11 and a top cover plate 12 covering the hollow bottom shell 11. The top cover plate 12 comprises a coin outlet 121, a positioning trough 122 at one side of the coin outlet 121, a plurality of protruding stop portions 1221 suspending in the positioning trough 122 and dividing the positioning trough 122 into a plurality of positioning spaces 1222 extending in direction perpendicular to the extending direction (see the hollow arrowhead sign) of the coin outlet 121, and a limiter 123 formed of a plurality of locating holes 1231 at one side of the positioning trough 122 corresponding to the positioning spaces 1222. The locating holes 1231 are arranged in parallel to the positioning spaces 1222. Further, the locating holes 1231 are arranged in an array such that the midpoint of the biased distance between two adjacent locating holes 1231 is in alignment with the protruding stop portion 1221 between two positioning spaces 1222, and each two adjacent positioning spaces 1222 are partially merged into each other. The casing 1 further comprises an adjustment block 13 provided above the limiter 123 and the positioning trough 122, and a coin ejector 14 provided below the top cover plate 12 corresponding to the coin outlet 121. The adjustment block 13 has a guide edge 131 and a guide face 132 disposed at one side, and a plurality of adjustment holes 133 cut through the top and bottom sides. The adjustment block 13 has a positioning structure 134 for positioning in the positioning trough 122 and the limiter 123. The positioning structure 134 comprises a positioning rod 1341 downwardly extending from the bottom side of the adjustment block 13 and positioned in one of the positioning spaces 1222, and a locking element 1342 inserted through one adjustment hole 133 and positioned in one of the positioning spaces 1222.

The coin ejector 14 comprises a base 141 pivotally coupled to the casing 1, a spring member 142 connected between one end of the base 141 and the top cover plate 12 remote from the pivoted point of the base 141 at the casing 1, a stop member 143 pivoted to the base 141. Further, the top cover plate 12 has a plurality of stop blocks 15 corresponding to the stop member 143 of the coin ejector 14.

The transmission mechanism 2 is mounted inside the casing 1, comprising a motor 21 and a transmission gear train having an output shaft 22. The output shaft 22 extends out of the top cover plate 12.

The rotary table 3 is coupled to the output shaft 22 of the transmission mechanism 2 and rotatable by the transmission mechanism 2, having a plurality of coin slots 31 equiangularly spaced around the center (the output shaft 22) and a plurality of protruding push portions 32 respectively protruded from the bottom wall corresponding to the coin slots 31.

The coin hopper 4 is provided above the rotary table 3, having a top-open coin collecting chamber 41 and a bottom coin outlet 42 in communication with the top-open coin collecting chamber 41 at the bottom side and facing the top side of the rotary table 3.

When in use, the adjustment block 13 is adjusted to a proper position to adjust the size of the coin outlet 121 of the casing 1 subject to the size of the coins to be counted. When coins are put in the coin collecting chamber 41 of the coin hopper 4, the motor 21 of the transmission mechanism 2 is started to rotate the rotary table 3, thereby causing the coins to be moved in the coin collecting chambers 41 and forced into the coin slots 31 of the rotary table 3 in proper order. When one coin fell to the inside of one coin slot 31, the respective protruding push portion 32 immediately pushes the falling coin toward the coin outlet 121 of the casing 1.

Figure 4:
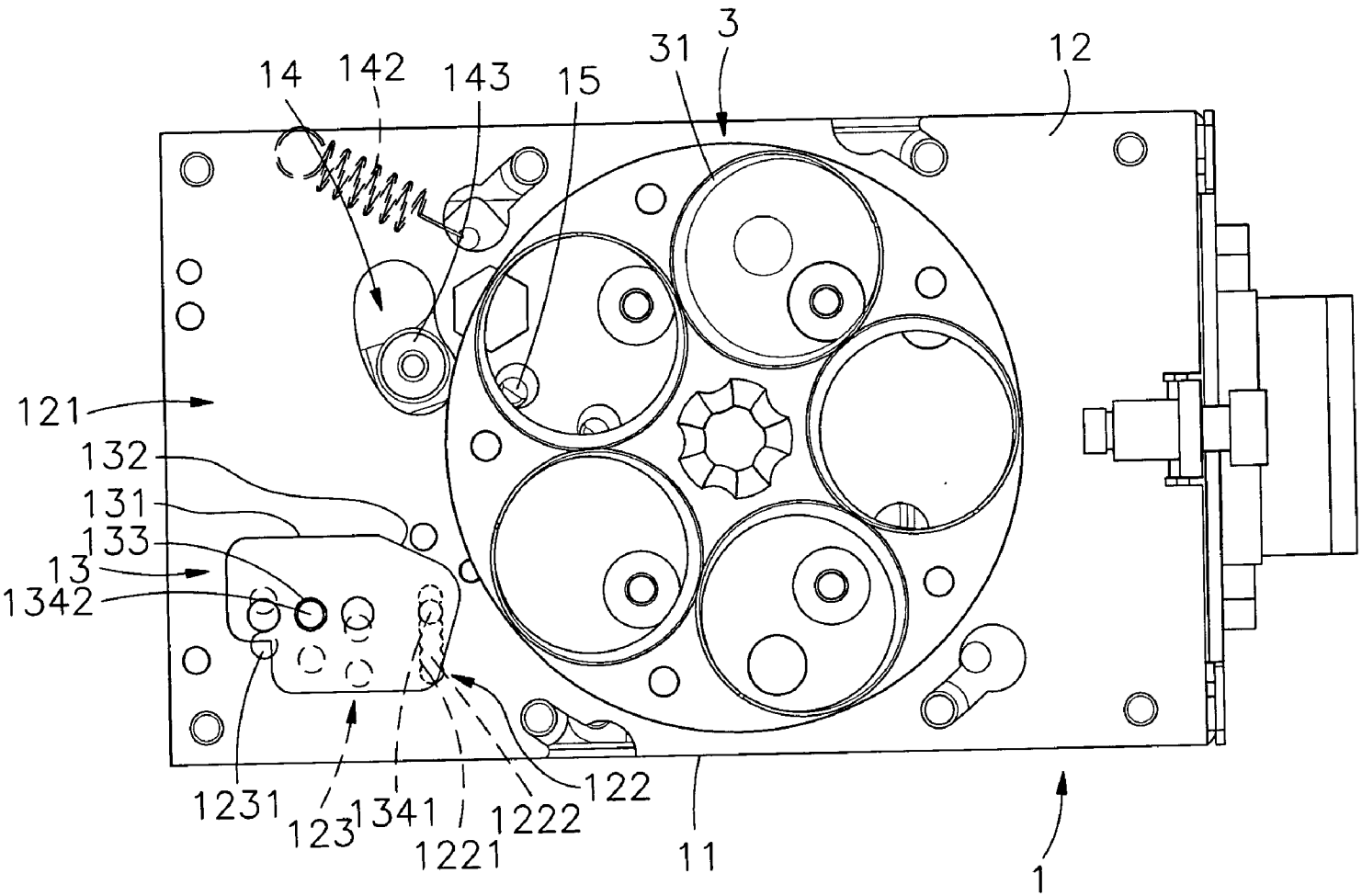
FIG. 4 is similar to FIG. 3 but showing the adjustment block shifted to another position.
Figure 5:
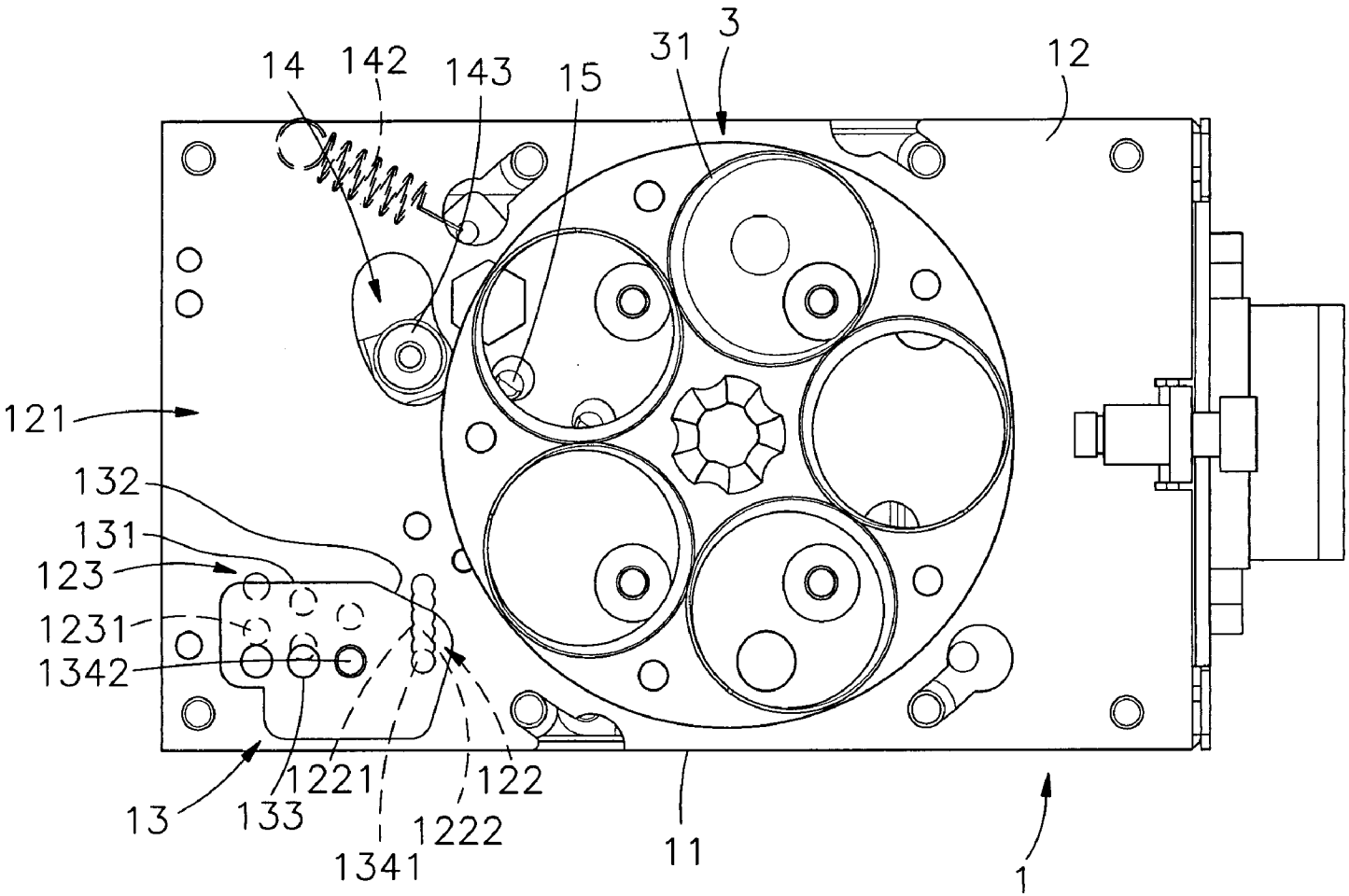
FIG. 5 is similar to FIG. 4 but showing the adjustment block shifted to another position.

Referring to FIGS. 3~5, when adjusting the size of the coin outlet 121 of the casing 1, the adjustment block 13 is moved to a proper location to have the positioning rod 1341 be positioned in the selected positioning space 1222 and held firmly in place by the adjacent protruding stop portions 1221. At the same time, and the adjustment holes 133 be aimed at the locating holes 1231, and then the locking element 1342 is inserted through one adjustment hole 133 into one locating hole 1231 to lock the adjustment block 13. At this time, the guide edge 131 of the adjustment block 13 is kept in parallel to the extending direction of the coin outlet 121. When wishing the change the size of the coin outlet 121, pull the locking element 1342 out of the locating holes 1231 of the limiter 123 and the adjustment holes 133 of the adjustment block 13, and then the positioning rod 1341 is shifted to the desired positioning space 1222, and then the locking element 1342 is fastened to the respective locating hole 1231 and the respective adjustment hole 133 to lock the adjustment block 13 again.

Further, if the protruding push portion 32 of the rotary table 3 does not force a fallen coin out of the coin outlet 121 when carrying the fallen coin to the coin outlet 121 during rotary motion of the rotary table 3, the fallen coin will touch the stop block 15 and be guided by the guide face 132 of the adjustment block 13 toward the guide edge 132 to force the stop member 1432 of the coin ejector 14 against the spring power of the spring member 143, therefore the fallen coin will be ejected by the coin ejector 14 in direction toward the coin outlet 121.

Figure 6:
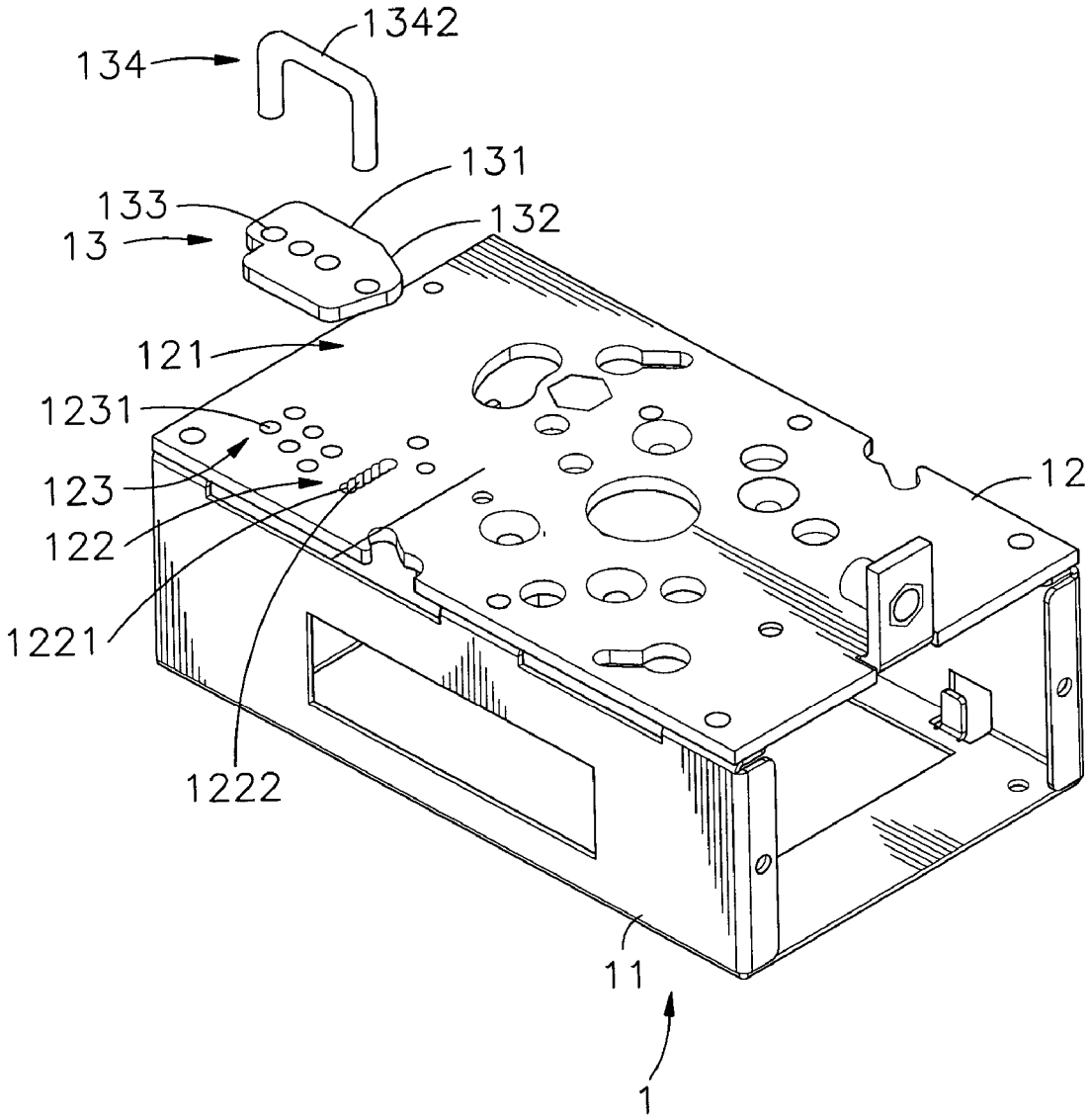
FIG. 6 is an exploded view of an alternate form of the coin outlet unit according to the present invention.
Figure 7:
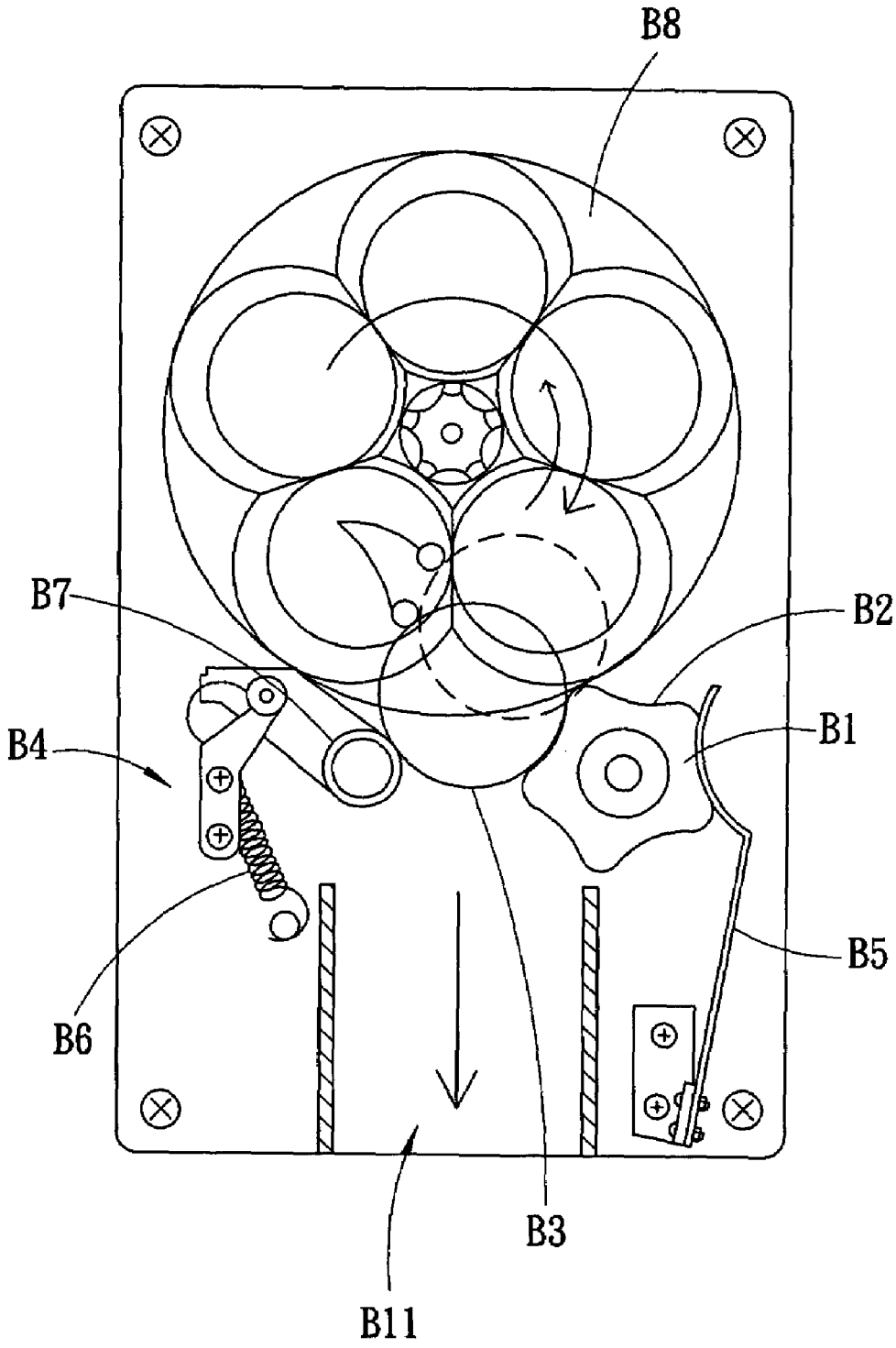
FIG. 7 is a schematic top view of a coin outlet unit according to the prior art design.

FIG. 6 shows an alternate form of the present invention. According to this embodiment, the locking element 1342 of the positioning structure 134 is an U-shaped locking bar insertable into two adjustment holes 133 of the adjustment block 13 and the corresponding locating hole 1231 of the limiter 123 and the corresponding positioning space 1222 of the positioning through 122 at a time.

As indicated above, the casing 1 has a locating trough 122 disposed at one side of the coin outlet 121 and divided into a plurality of positioning spaces 1222 arranged in a line perpendicular to the extending direction of the coin outlet 121, and a limiter 123 is provided at one side of the positioning trough 122. The limiter 123 is comprised of a plurality of locating holes 1231 arranged in parallel to the positioning spaces 1222. Further, the adjustment block 13 is selectively positioned in one of the positioning spaces 1222 and locked to the limiter 123 by a positioning structure 134 to control the size of the coin outlet 121, enabling the coin outlet 121 to fit any of a variety of coins. Further, because each two adjacent positioning spaces 1222 are partially merged into each other to shorten the distance between each two adjacent positioning spaces 1222, the adjustment block 13 can be moved to adjust the size of the coin outlet 121 without a long displacement.

Although particular embodiments of the invention have been described in detail for purposes of illustration, various modifications and enhancements may be made without departing from the spirit and scope of the invention.

What is claimed is:

1. A coin outlet unit comprising:

a casing, comprising a coin outlet and an adjustment structure for adjusting a size of said coin outlet, said adjustment structure comprising:

an elongated positioning trough, formed in said casing at one side of said coin outlet;

a plurality of protruding stop portions, disposed in said elongated positioning trough and dividing said positioning trough into a plurality of positioning spaces arranged in a line perpendicular to the extending direction of said coin outlet;

a limiter, spaced from said positioning trough at one side, comprising a plurality of locating holes arranged in parallel to said positioning spaces;

an adjustment block, selectively positionable in one of said positioning spaces and lockable to said locating holes to adjust the size of said coin outlet, comprising a plurality of adjustment holes and a positioning structure adapted to selectively lock said adjustment block to one of said positioning spaces to control the size of said coin outlet;

a transmission mechanism, mounted inside said casing;

a coin hopper, disposed above said casing and adapted to collect coins; and a rotary table, suspended inside said casing below said coin hopper and rotatable by said transmission mechanism to carry coins out of said coin hopper to said coin outlet.

2. The coin outlet unit as claimed in claim 1, wherein said positioning spaces are partially merged into one another.

3. The coin outlet unit as claimed in claim 1, wherein said locating holes are arranged in an array.

4. The coin outlet unit as claimed in claim 1, wherein said positioning structure comprises a positioning rod fixedly provided at a bottom side of said adjustment block for selectively inserting into one of said positioning spaces, and a locking member for inserting through said adjustment holes of said adjustment block into said locating holes of said limiter.

5. The coin outlet unit as claimed in claim 4, wherein said locking member is a U-shaped locking bar insertable through two of said adjustment holes of said adjustment block and said corresponding locating hole of said limiter and said corresponding positioning space of said positioning through.

6. The coin outlet unit as claimed in claim 1, wherein said adjustment block has a coin guide edge disposed at one side and extending in parallel to the extending direction of said coin outlet and a coin guide face extending from said coin guide edge.

7. The coin outlet unit as claimed in claim 1, further comprising a coin ejector spaced from one side of said coin outlet opposite to said limiter, said coin ejector comprising:

a base, pivotally mounted inside said casing;

a spring member, connected between a free end of said base and a part inside said casing; and a stop member, extending from said base and suspended in a top surface of said casing.

8. The coin outlet unit as claimed in claim 7, wherein said casing comprises a plurality of stop blocks corresponding to the stop member of said coin ejector.

9. The coin outlet unit as claimed in claim 1, said casing comprises a hollow bottom shell and a top cover plate covering said hollow bottom shell.

10. The coin outlet unit as claimed in claim 1, wherein said transmission mechanism comprises a motor and a transmission gear set coupled to said motor, said transmission gear set having an output shaft extending out of said casing and coupled to said rotary table.

11. The coin outlet unit as claimed in claim 1, wherein said rotary table comprises a plurality of coin slots equiangularly spaced around the center thereof and cut through top and bottom walls thereof, and a plurality of push portions protruded from the bottom wall corresponding to said coin slots for pushing coins out of said coin slots toward said coin outlet.

* * * * *